US007775403B2

(12) United States Patent
Monfeli et al.

(10) Patent No.: US 7,775,403 B2
(45) Date of Patent: Aug. 17, 2010

(54) POWER HAND TOOL HAVING A RETRACTABLE FRONT STAND

(75) Inventors: Robert Monfeli, Racine, WI (US); Charles Hulsey, Naperville, IL (US); Sze Kok Scott Fong, Causeway Bay (HK)

(73) Assignee: Robert Bosch GmbH, Stuttgart (DE)

( * ) Notice: Subject to any disclaimer, the term of this patent is extended or adjusted under 35 U.S.C. 154(b) by 865 days.

(21) Appl. No.: 11/215,949

(22) Filed: Aug. 31, 2005

(65) Prior Publication Data

US 2007/0045345 A1 Mar. 1, 2007

(51) Int. Cl.
*B67D 5/64* (2006.01)

(52) U.S. Cl. ..... 222/173; 222/146.5; 248/176.2; 248/688; 219/242

(58) Field of Classification Search ..... 222/146.2, 222/146.5, 79, 173; 219/242; 248/176.1, 248/176.2, 688, 117.1
See application file for complete search history.

(56) References Cited

U.S. PATENT DOCUMENTS

| | | | | |
|---|---|---|---|---|
| 1,700,876 | A | | 2/1929 | Blitz |
| 2,056,951 | A | | 10/1936 | Bohall et al. |
| 2,086,102 | A | | 7/1937 | Stradling |
| 2,662,962 | A | | 12/1953 | Green |
| 3,155,362 | A | * | 11/1964 | McCall ..... 248/688 |
| 4,379,516 | A | | 4/1983 | Barlogis |
| 4,776,124 | A | * | 10/1988 | Clifton ..... 42/94 |
| 5,215,230 | A | | 6/1993 | Lee |
| D404,622 | S | | 1/1999 | Singleton |
| 5,881,924 | A | | 3/1999 | Bokros |
| 6,105,824 | A | | 8/2000 | Singleton |
| 6,170,709 | B1 | | 1/2001 | Huang |
| D456,681 | S | | 5/2002 | Cheng |
| D458,524 | S | | 6/2002 | Cheng |
| 6,820,768 | B2 | | 11/2004 | Belanger |

* cited by examiner

*Primary Examiner*—J. Casimer Jacyna
(74) *Attorney, Agent, or Firm*—Greer, Burns & Crain, Ltd.

(57) ABSTRACT

Embodiments of a power hand tool of the type which has a main body portion, a front nose portion with a tool element extending forwardly from, a handle grip below the main body portion and an operating trigger adjacent the handle grip, further comprising a stand attached to the nose portion configured to pivot between retracted and extended positions, a means for biasing the stand toward its extended position, and a release mechanism adjacent the handle grip configured to hold the stand in its retracted position, and release the stand responsive to manipulation by a user.

15 Claims, 4 Drawing Sheets

POWER HAND TOOL HAVING A RETRACTABLE FRONT STAND

BACKGROUND OF THE INVENTION

The present invention generally relates to powered hand tools, and more particularly, to glue guns.

Glue guns that dispense molten thermoplastic materials are well known to those who are active in the arts and crafts. Many glue guns have a the general shape of a hand gun and therefore have a housing that comprises a barrel portion and a pistol grip configured to be gripped with one hand while the user uses a trigger which controls the heating circuitry and also presses a block of adhesive through a sleeve and into the melting chamber and also force molten thermoplastic material out of the melting chamber through the nozzle.

Because the material that flows from the nozzle is hot, the nozzle itself can become hot during use, so that if the gun is placed on a support surface, there is a danger that it could burn or otherwise damage the surface or other materials that may be on the surface. For this reason, such glue guns are often provided with legs or stands that enable the guns to rest on a support surface in an upright position with the nozzle spaced from the surface. Many of such leg or stand configurations are not aesthetically pleasing or demonstrate appreciable ergonomic advantages.

SUMMARY OF THE INVENTION

Embodiments of a power hand tool of the type which has a main body portion, a front nose portion with a tool element extending forwardly from, a handle grip below the main body portion and an operating trigger adjacent the handle grip, further comprising a stand attached to the nose portion configured to pivot between retracted and extended positions, a means for biasing the stand toward its extended position, and a release mechanism adjacent the handle grip configured to hold the stand in its retracted position, and release the stand responsive to manipulation by a user.

DETAILED DESCRIPTION OF THE PREFERRED EMBODIMENT

The preferred embodiment is a glue gun of the type which dispenses molten adhesive as a result of being heated by a heating element in the glue gun, and has a trigger mechanism which dispenses generally molten adhesive through a nozzle at the front of the glue gun. The preferred embodiment of the present invention has a retractable stand near the front or nose portion of the glue gun, which stand can be pivoted between a retracted and extended position. The stand is normally biased toward the extended position and includes a release mechanism which can be easily activated by a user of the glue gun. When the stand is in its extended position, the glue gun can be placed on a support surface and have the nozzle spaced from the support surface so that it is generally incapable of damaging the surface due to the high temperature of the nozzle during operation. While the preferred embodiment is shown in the environment of a glue gun, it should be understood that the invention can be implemented in other tools, such as a soldering iron, for example.

Figure 1:
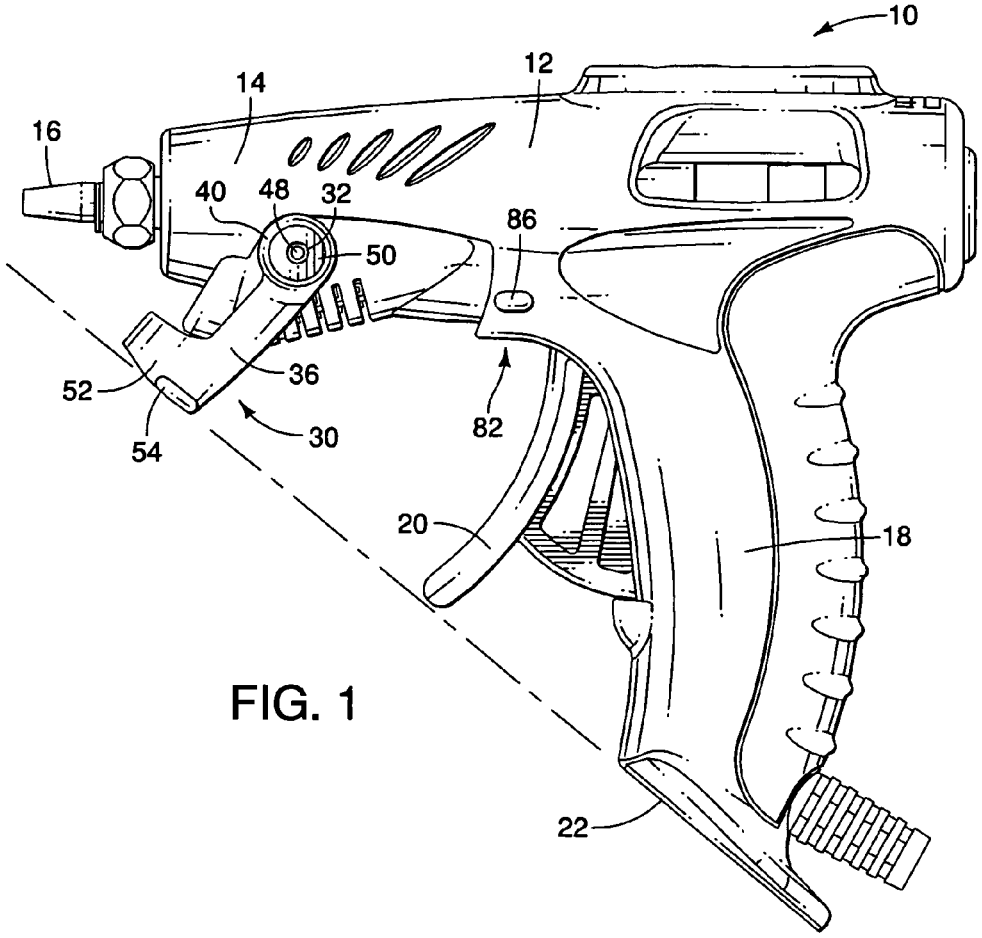
FIG. 1 is a left plan view of the preferred embodiment of the present invention and illustrating the stand in its extended position.

Turning now to the drawings, and particularly FIG. 1, a glue gun, indicated generally at 10, is illustrated and has a main body or barrel shaped housing 12, a front nose portion 14 that has a generally cylindrical shape and a nozzle structure 16 from which a heated adhesive is dispensed during operation of the glue gun. The glue gun 10 also has a handle or pistol grip 18 and a trigger 20 that controls the operation of the glue gun. The operation of the heating element and dispensing aspect of the glue gun 10 is not in and of itself a part of the present invention and therefore will not be discussed in further detail. The pistol grip 18 has a heel portion 22 that is generally flat and is a part of the glue gun that will support it in an upright rest position when it is placed on a support surface.

Figure 2:
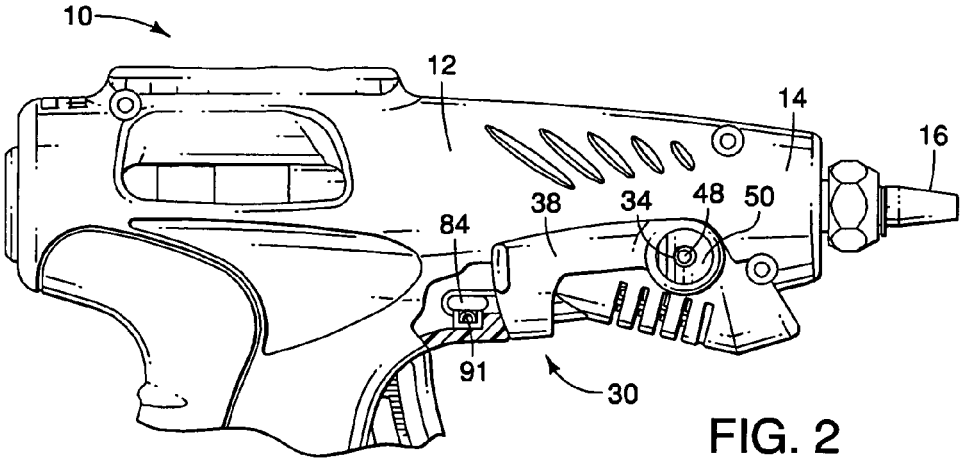
FIG. 2 is a right plan view of the preferred embodiment with the stand in its retracted position, and shown with portions removed to illustrate a portion of the release mechanism.

The glue gun 10 has a stand, indicated generally at 30, which is pivotally connected to the barrel or main housing at pivot point 32 as shown in FIG. 1, with a similar pivot point 34 being located on the opposite side of the nose portion 14 as shown in FIG. 2. Also, the stand 30 is shown in an extended position in FIG. 1 and a retracted position in FIG. 2. The configuration of the stand is such that when it is in a retracted position, it generally conforms to the general shape of the main housing 12 and the nose portion 14 and does not appreciably protrude from these items in a manner that would interfere with the operation of the glue gun or detract from its appearance.

Figure 5:
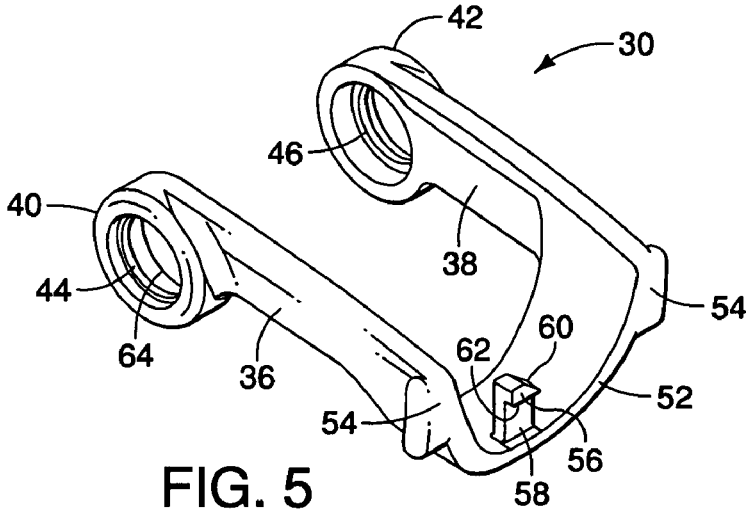
FIG. 5 is a perspective view of the stand portion of the preferred embodiment.
Figure 6:
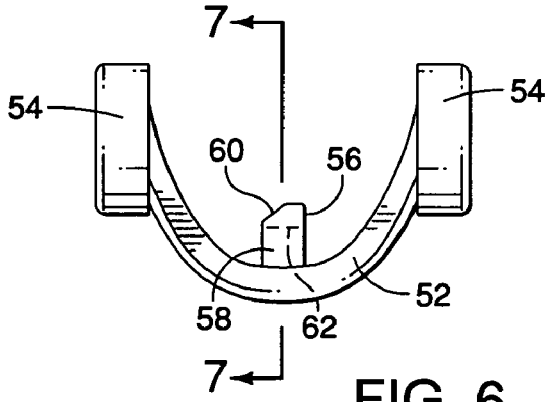
FIG. 6 is a rear end view of the stand shown in FIG. 5.
Figure 7:
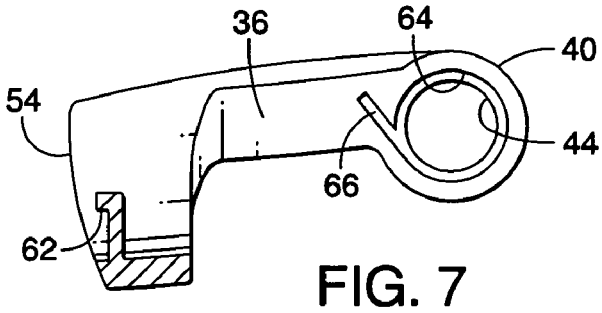
FIG. 7 is a cross section taken generally along the line 7-7 in FIG. 6.
Figure 8:
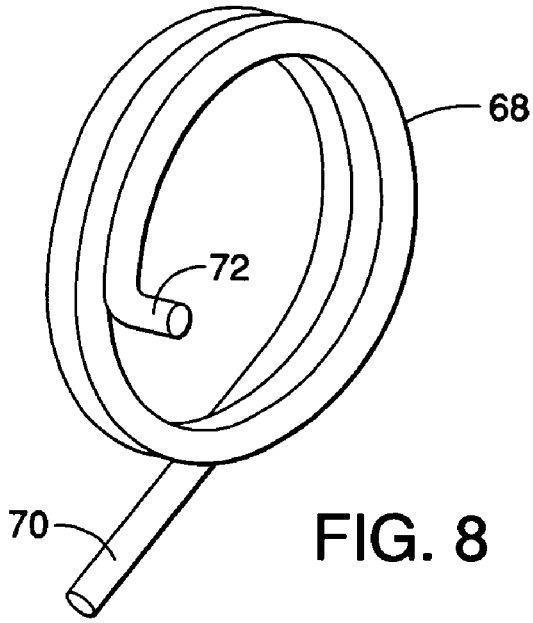
FIG. 8 is a perspective view of the spring that biases the stand shown in FIG. 5 toward its extended position.

Turning to FIGS. 5, 6 and 7, the stand is shown to have a pair of elongated legs 36 and 38, the outer end of which have pivot ends 40 and 42, each of which has respective apertures 44 and 46 for fitting around a raised cylindrical portion of the housing where a screw 48 and washer 50 are used (See FIGS. 1 and 2) to attach the pivot ends 40 and 42 to the nose portion 14 of the housing 12. The elongated legs 36 and 38 are interconnected by a curved bridging portion 52 located at the free end of the stand 30 with the surfaces 54 defining a foot portion that is configured to contact a support surface when the stand is extended in position and placed on a support surface.

Since the stand is retractable and extendable and is normally biased toward its extended position, a release mechanism is provided to hold the stand in its retracted position until it is desired to be released and moved to its extended position. The stand therefore has a clip 56 that is formed together with a neck 58 and extends from the center of the bridging portion 52 as is best shown in FIGS. 5 and 6. The clip has a sideways sloped end portion 60 that is configured to contact a cooperating release member when the stand 30 is returned to its retracted position so that it will automatically be held in place. In that regard, an under cut shelf 62 provides a surface which the member can engage and hold the stand in its retracted position.

As shown in FIG. 7, the aperture 44 in the pivot end 40 has an annular recess 64 that also extends in the form of a groove 66 inwardly along the leg 36. The groove 66 is configured to receive a spring, indicated generally at 68, and more particularly a straight end portion 70 thereof The spring 68 is a torsion spring that also has a transverse opposite end 72 that is configured to engage an opening in the housing. The torsion spring 68 is therefore positioned to provide a biasing force tending to urge the stand 30 from its retracted position shown in FIG. 2 to its extended position shown in FIG. 1 when it is released during operation.

Figure 4:
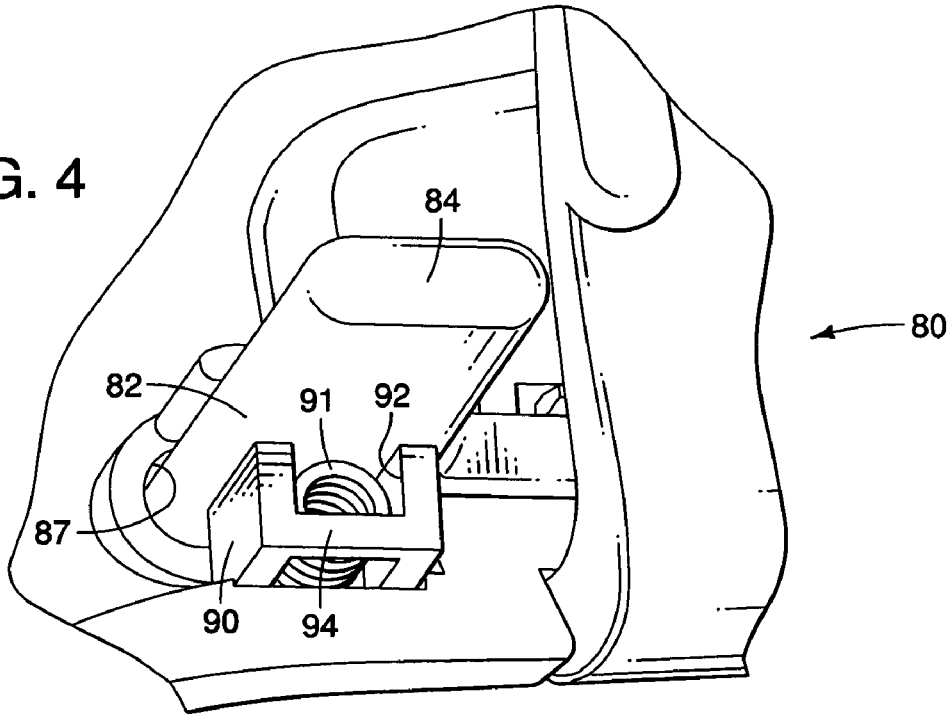
FIG. 4 is a lower right partial perspective of a portion of the preferred embodiment, and particularly illustrating the release mechanism of the present invention.
Figure 9:
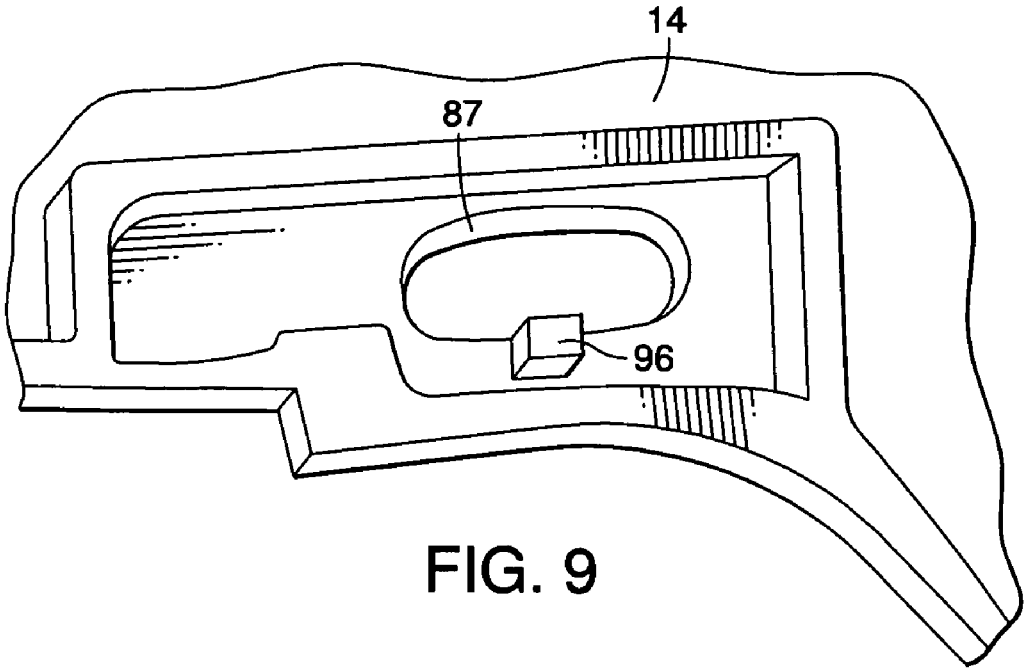
FIG. 9 is a perspective view of a portion of one segment of the housing illustrating a portion of the release mechanism of the preferred embodiment.

A release mechanism, indicated generally at 80, is configured to hold the stand in its retracted position and release the same so that it can be extended. The release mechanism 80 comprises an elongated member 82 that has a left end portion 84 as well as a right end portion 86, both end portions of which extend through an opening in the housing 12, such as opening 87 as shown in FIGS. 4 and 9. In this regard, it should be understood that the housing 12 is preferably manufactured in two complementary clam shell sections that are attached to one another during the assembly process. Therefore, the left section in which enables the left end 86 to protrude as shown in FIG. 1 has an opening similar to the opening 86 which is formed in the right section.

Figure 3:
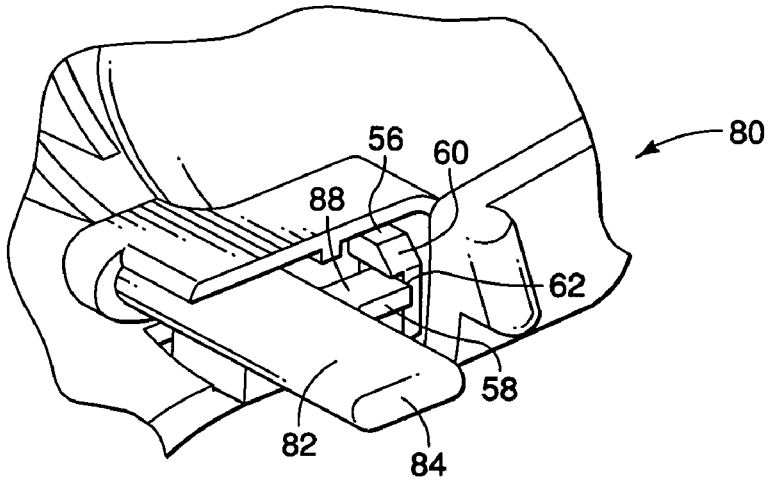
FIG. 3 is a upper right partial perspective of a portion of the preferred embodiment, and particularly illustrating the release mechanism of the present invention.

The member 82 also has a generally centered transverse extension 88 that is configured to engage the shelf 62 when the stand is in its retracted position. As shown in FIG. 3, the extension is positioned so that when the stand 30 is moved toward its retracted position, the sloped surface 60 will engage the left edge of the extension 88 and force the member 82 to the right as shown in FIG. 3 until it clears the clip 56. The member 82 will then move back to the left to its default, i.e., locked position as shown in FIG. 3 wherein the upper surface of the extension 88 engages the shelf 62.

The member 82 also has a preferably integrally formed boxlike structure 90 on the underside of the member 82 which has openings 91 on opposite ends thereof, only one of which is visible in FIG. 4. Inside of the boxlike structure 90 is a spring 92 which is held captive by end wall 94. The spring 92 is sized so that it can be compressed a sufficient amount to enable the member 82 to move laterally a sufficient distance to enable the transverse extension 88 to clear the clip 56 and hold the stand in its retracted position.

As shown in FIG. 9, the housing 14 has a tab 96 adjacent the opening 86 that is configured to be inserted into the opening 91 in position to engage the end of the spring 92. Since there is a tab 96 located on both housing 12 sections, it should be understood that the 92 spring can be compressed from either direction. The operation of the spring has the effect of returning the member 82 to its nominal or default position after a user has pushed one end or the other of the slideable member 82 to release the stand 30.

It should be apparent from FIGS. 1 and 2 that a user can operate the glue gun in a normal manner with the stand in its retracted position, and can push either end 84 or 86 with a finger or thumb of the hand in which is being used to hold the gun. Such one handed operation makes it very convenient for the user to manipulate the member 82 and release the stand 30 so that it can move to its extended position thereby enabling the gun to be held upright on a supporting surface such as a table or the like. In this regard, the dashed line shown in FIG. 1 extends from the heel portion 22 to the foot portions 54 of the stand and in this position the nozzle 16 is spaced away from the support surface as is desired. When the gun is to be used again, the user can lift it up and use their opposite hand to push the stand back in its retracted position and it will click into its locked position in the manner as previously described.

From the foregoing it should be understood that a very convenient and aesthetically pleasing stand has been shown and described which is easily operated. It should also be understood that while a glue gun has been shown and described, an embodiment of the stand could be implemented in a soldering iron or other device, tool or implement where an upright rest position is a desirable feature.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the following claims.

What is claimed is:

1. A power hand tool comprising:

a main body portion;

a front nose portion configured to have a tool element extending forwardly therefrom;

a handle grip below the main body portion;

a trigger adjacent the handle grip for operating the tool;

a retractable stand attached to the nose portion configured to pivot between retracted and extended positions;

means for biasing said stand toward its extended position;

a release mechanism adjacent the handle grip configured to hold said stand in its retracted position without user restraint when placed in its retracted position, and to release said stand only when manipulated by a user;

said release mechanism comprises a member positioned within the main body portion and configured to engage a surface of said stand when said stand is in its retracted position, said member having at least one exposed portion extending from the main body portion and configured to be manipulated by the user to release said stand, said member being elongated and having an exposed portion on opposite sides of the main body portion, said member being slideable relative to the main body portion and having a center catch for engaging said surface of said stand and for releasing said surface when said member is moved to either side by manipulation by the user.

2. A power hand tool as defined in claim 1 wherein said release mechanism further comprises a spring means for returning said member to a default position after it has been manipulated to release said stand, said default position being generally centered and in position to engage said surface.

3. A power hand tool as defined in claim 1 wherein said surface is a clip that extends from an outer end of said stand.

4. A power hand tool as defined in claim 2 wherein said spring means comprises a compression spring retained in said member and is configured to be compressed when said member is moved to either side.

5. A power hand tool as defined in claim 1 wherein the nose portion has a generally cylindrical shape, said stand having a pair of spaced apart leg portions, each of which has a pivot end portion for pivotal attachment to generally opposite sides of the nose portion, and a curved bridging free end portion interconnecting said leg portions, the curvature of said free end portion being generally similar to the curvature of the nose portion so that said stand generally conforms to the shape of the nose portion.

6. A power hand tool as defined in claim 5 wherein said stand further comprises a clip extending from the center of said free end portion, said clip having said surface which is engaged by said release mechanism.

7. A power hand tool as defined in claim 6 wherein said clip has a sloped side surface configured to contact said center catch during retraction of said stand and cause said member to slide to one side during movement of said stand to said retracted position, said member then returning to said default position to hold said stand in its retracted position.

8. A power hand tool as defined in claim 5 wherein said biasing means comprises at least one torsion spring positioned around said pivotal attachment of at least one pivot end portion, one end portion bearing against said stand and the other end portion bearing against the housing.

9. A glue gun comprising:

a generally handgun shaped housing with a pistol grip having a heel end and a main barrel portion with a front nozzle from which hot glue can be dispensed;

a trigger adjacent the pistol grip for operating the gun;

a front stand having a pivot end and an outer end, said stand being pivotally attached to the housing near the front nozzle, said stand being pivotable between extended and retracted positions;

means for biasing said stand toward its extended position;

a release mechanism adjacent the pistol grip configured to hold said stand in its retracted position without user restraint when placed in its retracted position, and to release said stand only when manipulated by a user, thereby causing said biasing means to move said stand to its extended position;

wherein said release mechanism comprises a moveable elongated member having end portions that are accessible from opposite sides of the housing, and operates to release said stand when said member is moved by a user.

10. A glue gun as defined in claim 9 wherein said stand is configured to generally have the shape of said barrel portion when it is in its retracted position.

11. A glue gun as defined in claim 9 wherein said stand has two elongated leg portions, each of which has a pivotable connection to the housing said pivot end, said biasing means comprising at least one torsion spring positioned around said pivotal attachment of at least one pivot end portion, one end portion bearing against said stand and the other end portion bearing against the housing.

12. A glue gun as defined in claim 9 wherein said member is positioned and configured to be manipulated to release said stand by a user using the same hand that is holding the pistol grip.

13. A glue gun as defined in claim 9 wherein said member has a center catch for engaging a surface of said stand and for releasing said surface when said member is moved to either side by manipulation by the user.

14. A glue gun as defined in claim 13 wherein said release mechanism further comprises a spring means for returning said member to a default position after it has been manipulated to release said stand, said default position being generally centered and in position to engage said surface.

15. A glue gun as defined in claim 11 wherein said stand has a bridging portion interconnecting said leg portions at said free end of said stand and defining spaced apart foot portions which contact a support surface, the distance between said foot portions and said pivot end being sufficient space the end of the nozzle away from the support surface when the gun is resting on the support surface such that the heel end and foot portions contact the support surface.

* * * * *